US005228654A

United States Patent [19]

Carpentier

[11] Patent Number: 5,228,654

[45] Date of Patent: Jul. 20, 1993

[54] BAG HOLDER

[76] Inventor: Paul-André Carpentier, 1750 De Vitré , Québec, Québec, Canada, G1J 1Z6

[21] Appl. No.: 882,420

[22] Filed: May 13, 1992

[51] Int. Cl.[5] ..... B65B 67/04

[52] U.S. Cl. ..... 248/99; 248/97; 248/100

[58] Field of Search ..... 248/100, 101, 95, 97, 248/99; 220/404, 908; 141/108, 109, 390, 391, 314

[56] References Cited

U.S. PATENT DOCUMENTS

| | | | |
|---|---|---|---|
| 289,181 | 11/1883 | Valentine | 248/99 |
| 575,403 | 1/1897 | Morton | 248/100 |
| 972,870 | 10/1910 | Kandlbinder | 248/99 |
| 2,062,023 | 11/1936 | Gosselin | 248/99 |
| 2,188,047 | 1/1940 | Jones | 248/99 |
| 3,756,548 | 9/1973 | Santarelli | 248/99 X |
| 3,847,332 | 11/1974 | Murai | 248/99 |
| 4,304,378 | 12/1981 | Briggs | 248/97 |
| 4,312,489 | 1/1982 | Paetzold | 248/97 |
| 5,139,219 | 8/1992 | Navarro | 248/99 X |

*Primary Examiner*—J. Franklin Foss

[57] ABSTRACT

A bag holder for holding bags such as trash bags used for gardening. It comprises a rod having two side arms integrally projecting therefrom and extending forwardly. A sleeve with large rounded heads are set at the ends of each arm. The upper edge of the bag is set around the rod and the sleeves in order to be held and kept open. The large heads of the sleeves apply a pressure to tighten the upper edge around the rod without puncturing the bag. The bend angle of the arms could be change in combination with the moving of the sleeves along the arms to accommodate bags of different sizes, shapes or purposes. The rod is vertically supported by a vertical rod or by an handle.

14 Claims, 9 Drawing Sheets

BAG HOLDER

FIELD OF THE INVENTION

The present invention is concerned with a bag holder, particularly for use with trash bags for gardening, wherein the bag is held generally upright and kept wide open for inserting leaves, grass, or other refuse. It is suitable for bags of various sizes, shapes or purposes. It may be used, for example, inside homes or buildings as a common garbage bag holder, or as a holder for a postal bag or for a sack of recyclable items.

DESCRIPTION OF PRIOR ART

There exists numerous types of bag holders designed for all kinds of purposes, especially for garbage bags used for gardening. Most of these holders involve a ring around which is placed the upper edges of a stretchable plastic bag. Example of these devices are disclosed in Swiss patent 587,752, U.S. Pat. Nos. 3,866,872, 4,312,489, 4,319,726, 4,358,083, 4,702,445, 4,708,307, 4,940,201, 5,033,703, Canadian patent 1,280,735, and Canadian laid-open patent applications 2,001,175 and 2,004,264.

Other numerous kinds of bag holders have also been disclosed, such as U.S. Pat. Nos. 4,069,993, 4,846,427, 5,014,943 and Canadian patent 1,101,819. However, none of these prior art bag holders can be used in a very wide range of applications, covering almost every application that can be done with bag holders and adapting to almost any kind of bag size, shape and purpose, while being very simple and cheap to manufacture.

SUMMARY OF THE INVENTION

The object of the present invention is to provide a bag holder that can hold and keep wide open bags of almost any size, shape or purpose, which is both very simple and adapted to be used in a wide variety of applications.

More particularly, the invention provides a bag holder for holding open bags of various sizes, the bag holder comprising:

a rod having a main portion and two side arms integrally projecting from the main portion and extending forwardly, bent perpendicularly to the main portion, each of the two arms having an end and being bent substantially according to the size of the bag;

two end members, each mounted on the end of one of the arms, the end members having a large rounded head projecting forwardly therefrom;

male and female variable length interconnecting means provided between each of the end members and their corresponding are, thereby allowing the end members to be moved to a desired position according to the size of the bag; and means to support the rod.

The bag as an upper edge which is set around the rod and the end members in order to be held and kept open. The large head of each end members applies a pressure to tighten the upper edge of the bag without puncturing it.

According to a preferred embodiment, the end members comprise sleeves slidable around the ends of the arms and the interconnecting means include a slight curving of the end of the arms generating holding friction forces inside the sleeves when they are mounted on the end of one of the arms.

The main portion of the rod preferably has at least one middle stem projecting therefrom acting as a link between the bag holder and the means to support the rod. The at least one middle peg may be a formed by a U-shaped bend in the rod.

The bag holder may be a vertical post with a stem receiving upper end that also may further comprise a lower sharp end having a foot pedal such that a force applied on the foot pedal moves the sharp end into the ground.

The bag holder may also be a ground support, comprising two parallel horizontal arms extending forwardly to avoid toppling of the bag holder and having an upper end engaging a lower end of the stem. A handle may also be suitable as a hand support.

A non restrictive description of a preferred embodiment will now be given with reference to the appended drawings.

DESCRIPTION OF A PREFERRED EMBODIMENT

Figure 1:
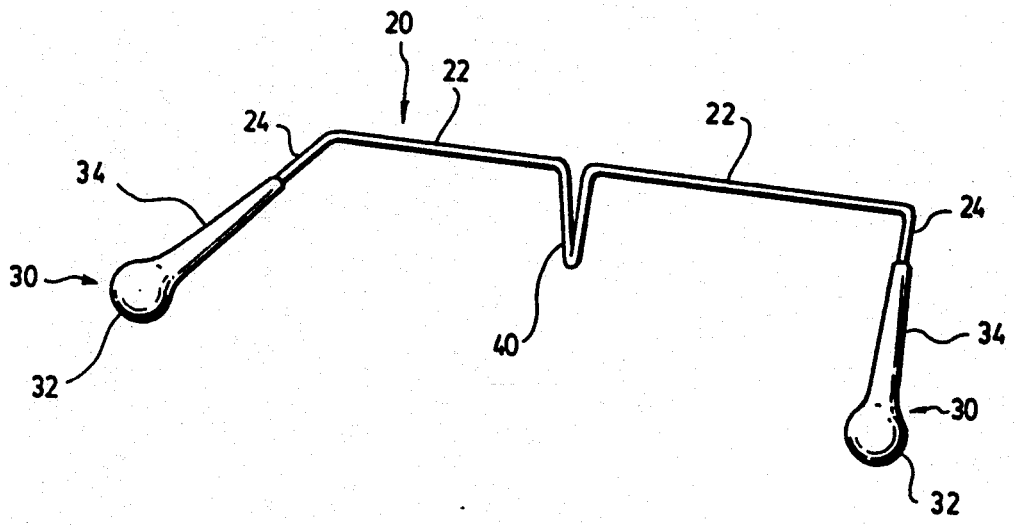
FIG. 1 is a perspective view of the rod and the two end members, according to the invention.

The bag holder according to the invention as shown in FIG. 1 comprises a rod 20 having a main portion 22 and two side arms 24 integrally projecting from the main portion 22 and extending forwardly. The arms 24 are bent perpendicularly to the main portion 22 in the same plane. The arms 24 may also be welded to the main portion 22, or otherwise fastened to it such as screws (not shown) or by means of holes, in which an end of the arms 24 is inserted therein (see FIG. 15).

The rod 20 is made of a solid, flexible material to make the arms easily adjustable by a slight change in their bending angle, according to the size of the bag 10, without showing signs of fatigue. It must also stand the forces involved in supporting the bag 10 without deformation. An appropriate metal or plastic material is suitable for this purpose. The rod 20 has a circular cross-section but any other shape may be suitable.

Figure 2:
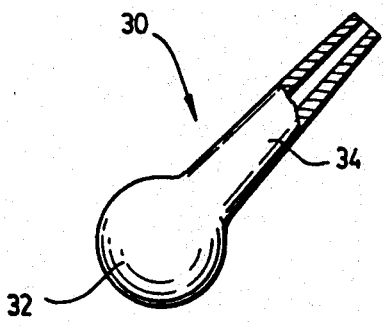
FIG. 2 is a perspective view of an end member.

End members 30 are provided at the forward ends of the arms 24. As shown in FIG. 2, the end members 30 comprise a large, substantially rounded head 32 that is used to apply a tightening force on the upper edge of the bag 10. This force allows the bag 10 to be held on the rod 20, thus allowing the bag 10 to be held in an upright position and wide open so trash can be put therein. The trash may be leaves, grass or other refuse, in the case that it is used in a garden for example.

The heads 32 are preferably the projection of the sleeves 34 and the sleeves 34 are slidably mounted around the ends of the arms 24. The sleeves 34 and the ends of the arms 24 form a male and female variable length interconnecting means. However, it would have been possible to have the heads 32 rigidly attached to the end of a small shaft which is inserted inside the arm 24 (not shown).

The sleeves 34 are inserted around the arms 24 until the setting allows the bag 10 to be held properly. This involves sliding or moving the sleeves 34 about the arms 24 between boundary positions from when the back end of each sleeves 34 touches the main portion 22 to where the sleeves 34 has a minimum grip on the arms 24.

Figure 3:
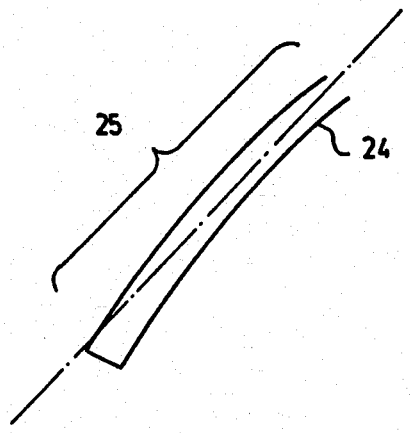
FIG. 3 is a perspective view of an end of an arm.
Figure 4:
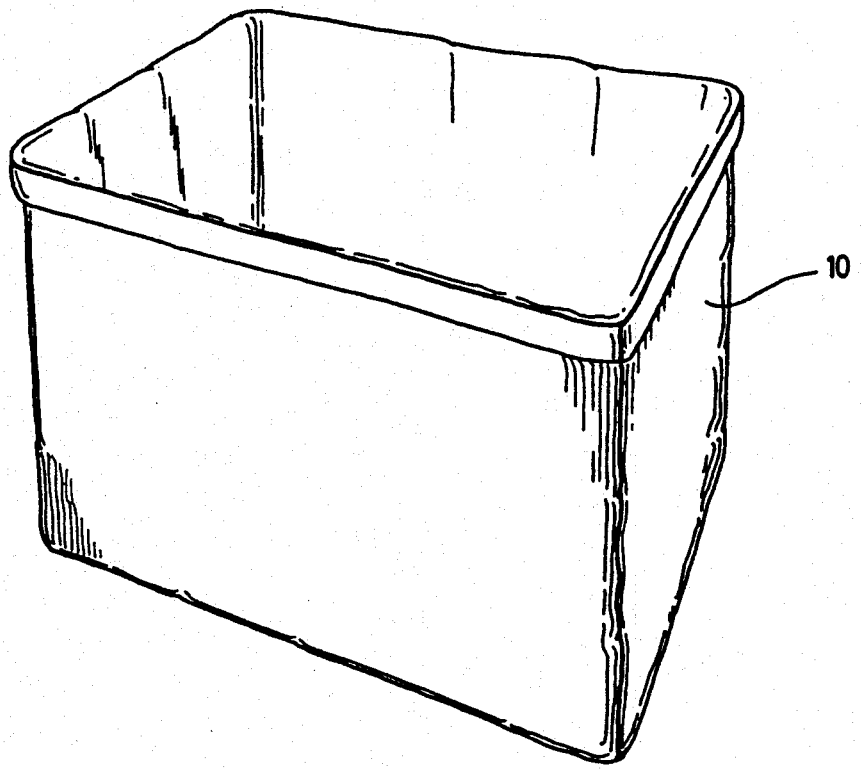
FIG. 4 is a perspective view of the bag holder holding a bag.

The sleeves 34 are prevented from moving in use by means of a friction force generated by a slight curve of the ends of the arms 24 done prior to the insertion of the sleeves 34 (FIG. 3). Since the sleeves 34 are straight, they force the ends 25 to straighten and they will push against the interior of the sleeves 34. The sleeves 34 may also be prevented from moving by means of a very narrow tolerance between the interior diameter of the sleeve 34 and the external diameter of the arm 24 (not shown), so the sleeve 34 may be difficult to move. Similar results can be obtained with the use of a high friction material placed between the arms 24 and the sleeves 34 (not shown). The sleeves 34 may also be threaded internally and meshed with corresponding threads on the arms 24 (not shown).

To set the sleeves 34 to their proper positions, they can be slid by hand while turning them at the same time to ease the sliding movement.

The rod 20 has one middle stem 40 projecting therefrom acting as a link between the main position 22 and a means to support the rod 20. The stem 40 is a formed within the rod 20 itself wherein it integrally projects therefrom and is bent sharply as shown in FIG. 1.

Figure 5:
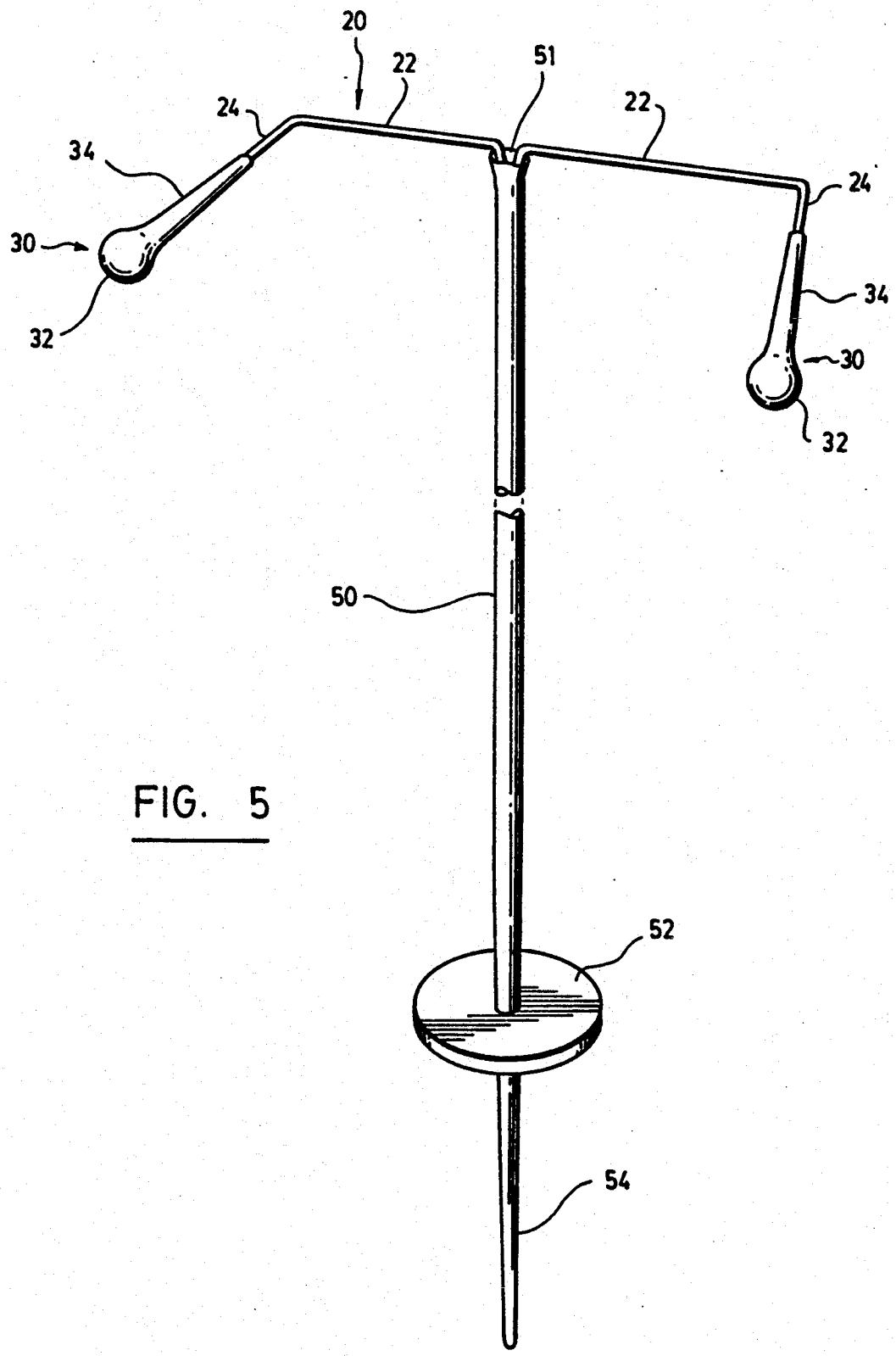
FIG. 5 is a perspective view of the bag holder with a foot pedal.
Figure 6:
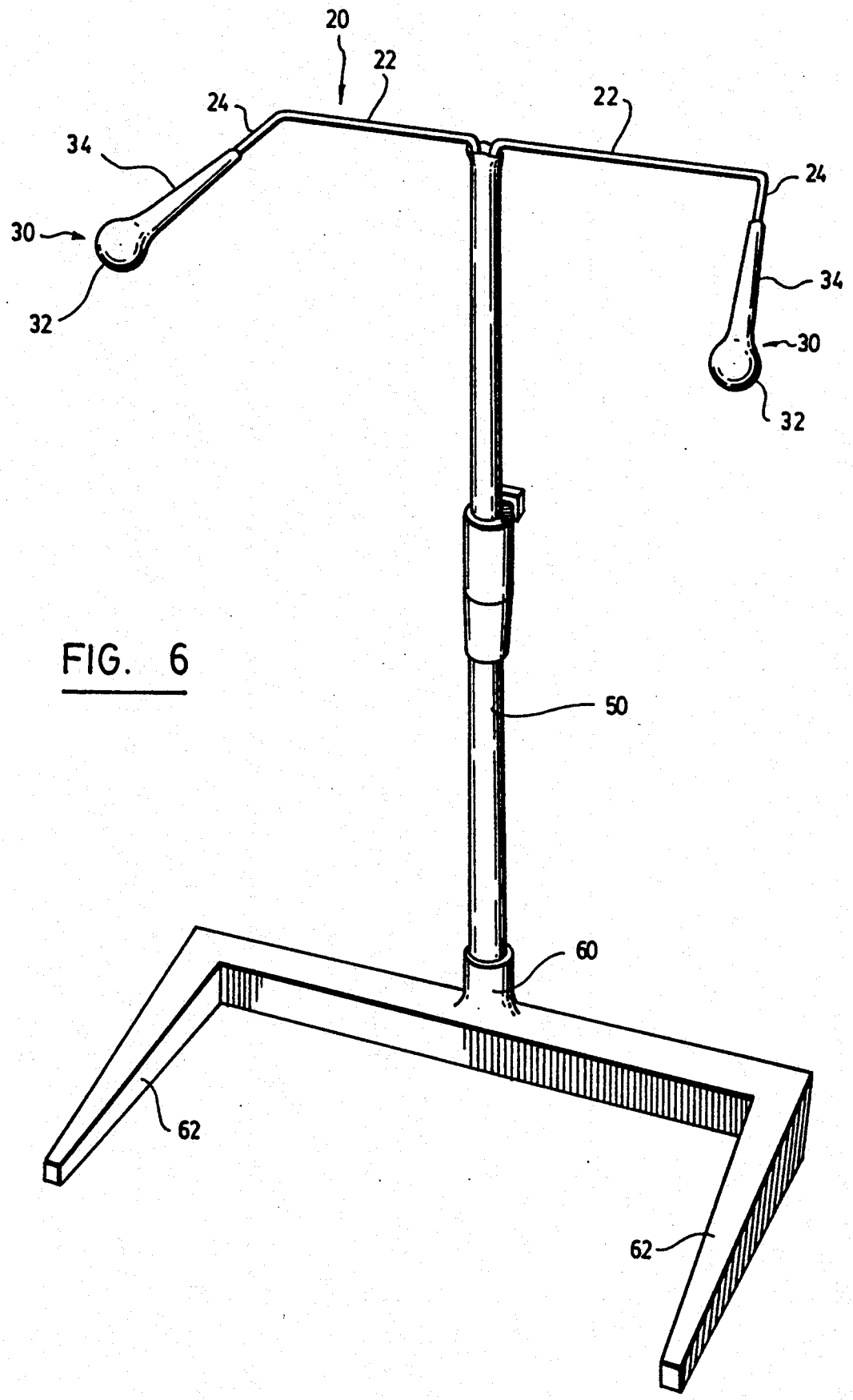
FIG. 6 is a perspective view of the bag holder with a ground support.

There are many embodiments for supporting the rod 20. First, the bag holder is supported vertically by a vertical post 50 which allow the bag holder to have space beneath it so it can have space for the bag 10, as shown in FIGS. 5 and 6. The post 50 has an upper opened end 51 in which the middle stem 40 is inserted. The post 50 may be telescopic to accommodate the user and the upper opened end 51 may be designed to hold simultaneously two rods 20, one extending forwardly and the other rearwardly.

As it can be seen in FIG. 5, the post 50 has a sharp end 54, located at its lower end. A force applied by the foot on a foot pedal 52 drives the sharp end 54 into the ground, so the vertical post 50 can be supported.

To hold the post 50, a ground support 60 that is laid on the ground or on the floor may also be provided. The ground support 60 comprises two parallel horizontal arms 62 extending forwardly to avoid toppling of the bag holder, as shown in FIG. 6.

Figure 7:
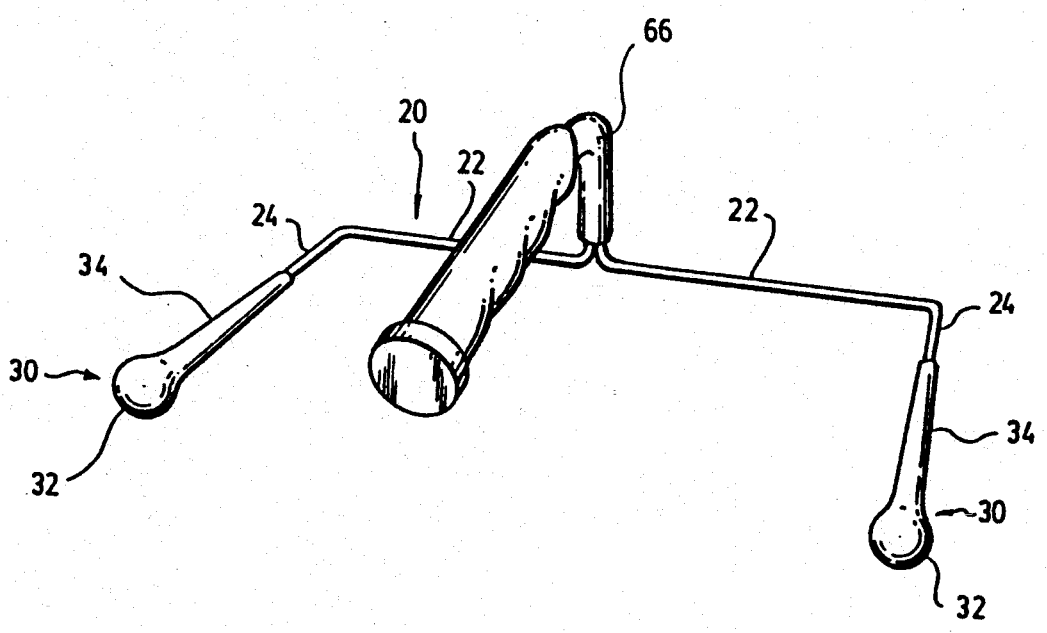
FIG. 7 is a perspective view of the bag holder with a handle.
Figure 8:
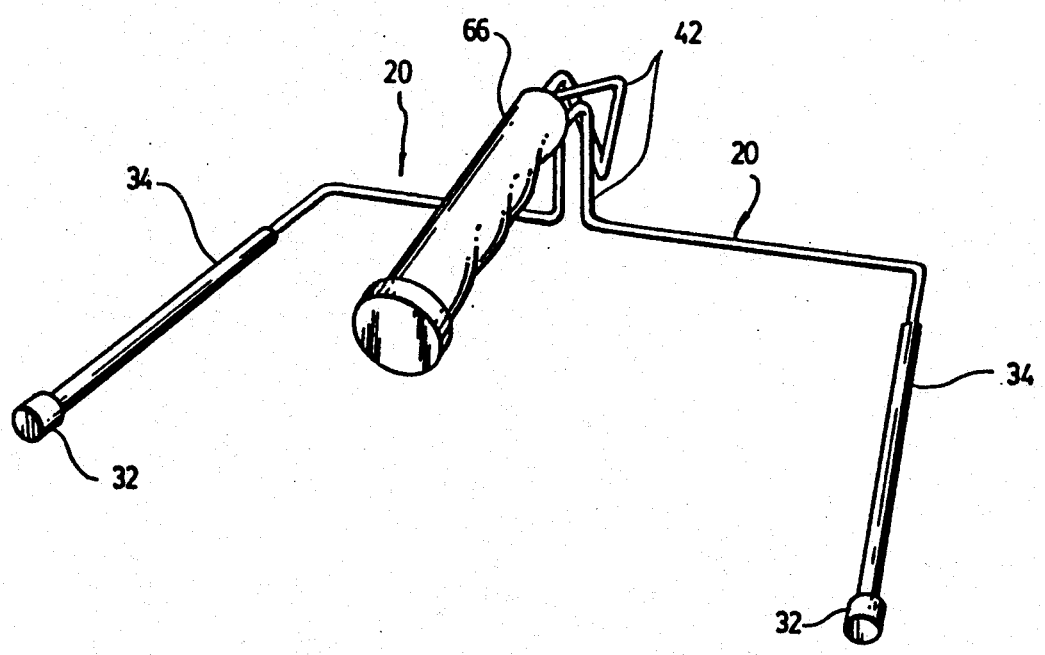
FIG. 8 is a perspective view of the bag holder with a handle and a middle stem.
Figure 9:
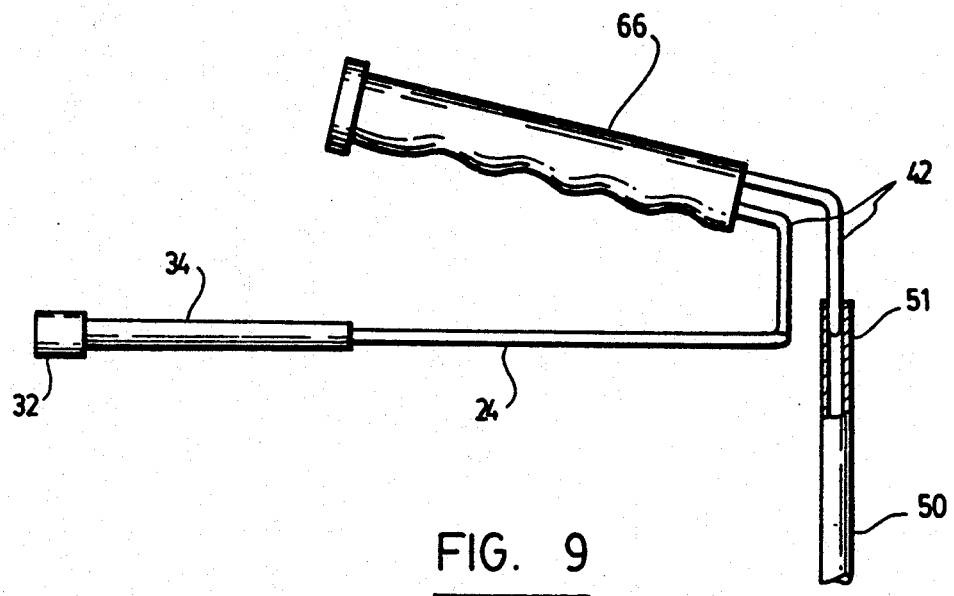
FIG. 9 is a right side view of the bag holder of FIG. 8.
Figure 10:
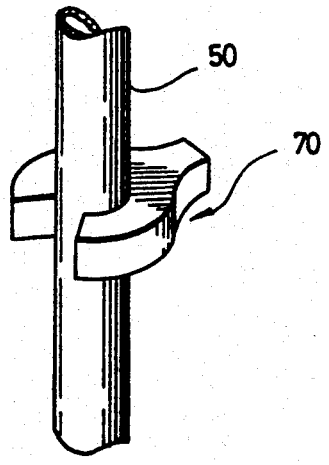
FIG. 10 is a top view of a rubber vise.

Instead of or in addition to the above mentioned vertical post 50 or ground support 60, a handle 66 can be provided so the bag holder can be held in hand or easily moved, as shown in FIGS. 7, 8 and 9. The handle 66 allows the user to carry the rod 20 along with the bag and the trashes therein.

FIG. 7 shows a handle 66 that can be inserted directly into the stem 40 used with the post 50.

In FIGS. 8 and 9, the bag holder is designed to allow both the handle 66 and the post 50 to be used in the same time. This is done with the use of two loops forming a double stem numbered 42. They also show a different kind of substantially rounded heads 32.

Figure 11:
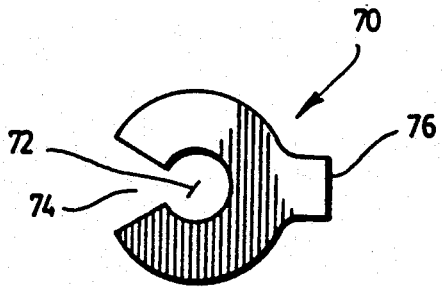
FIG. 11 is a rear perspective view of a rubber vise installed on a vertical post.

As shown in FIGS. 10 to 13, the means to support the rod 20 may also be a vise 70, made of rubber or like, that has a central hole 72 and a front opening 74. The vise 70 is set around the post 50 at a desired height as shown in FIG. 11. The hole 72 has a diameter slightly smaller than the diameter of the post 50 so it can be more tightly held around it. The friction between the rubber vise 70 and the post 50 holds the vise 70 in place. The vise 70 has a front protuberance 76.

Figure 12:
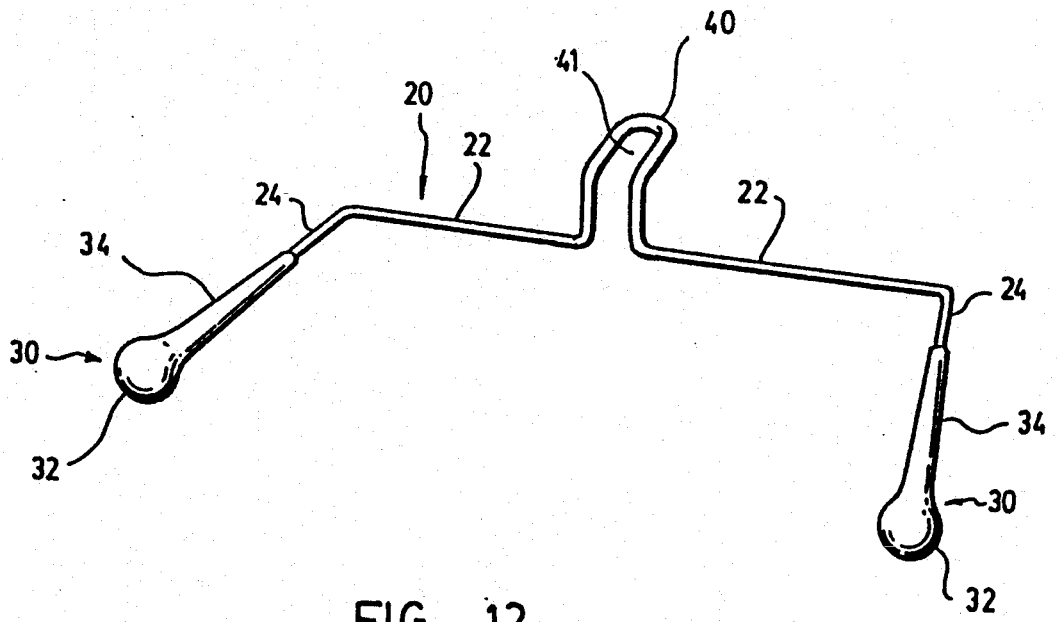
FIG. 12 is a perspective view of the bag holder used with the rubber vise of FIG. 10.
Figure 13:
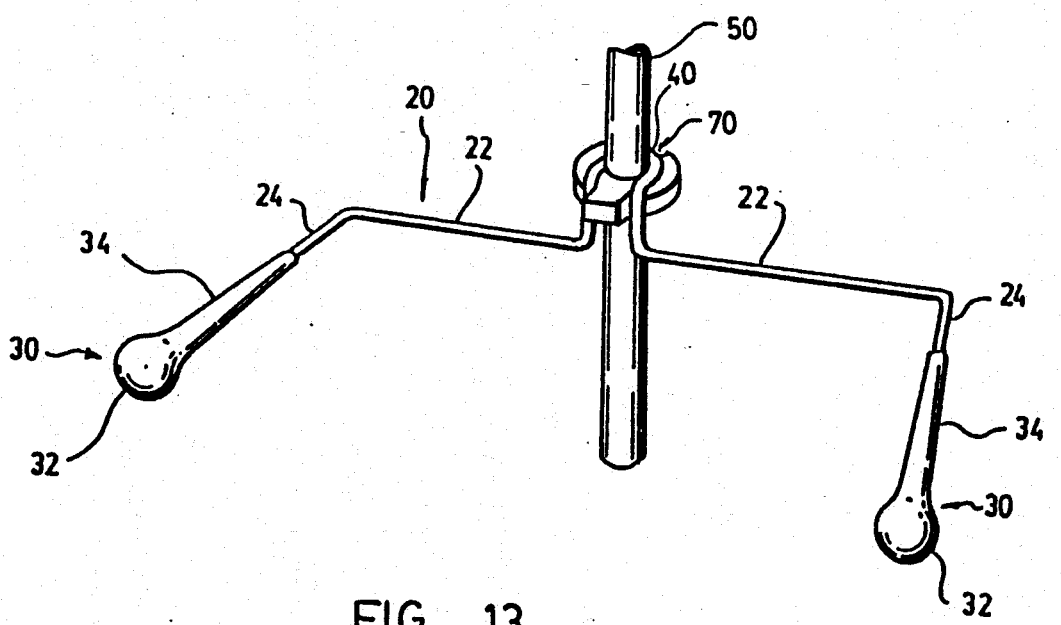
FIG. 13 is a perspective view of the bag holder of FIG. 12 mounted on the rubber vise installed as shown on FIG. 11.

The rod 20 has a middle stem 40 extending vertically and then horizontally, integrally projecting therefrom, between which the protuberance 76 extends. The left and the right parts of the stem 40 have a gap 41 therebetween which has substantially the diameter of the post 50. In use, the rod 20 of FIG. 12 is set as shown in FIG. 13. The stem 40 is set around the post 50, located into the gap 41. The horizontal part of the stem 40 is then laid on the vise 70, as the left and right vertical parts of the stem 40 rests against the side of the vise 70.

Figure 14:
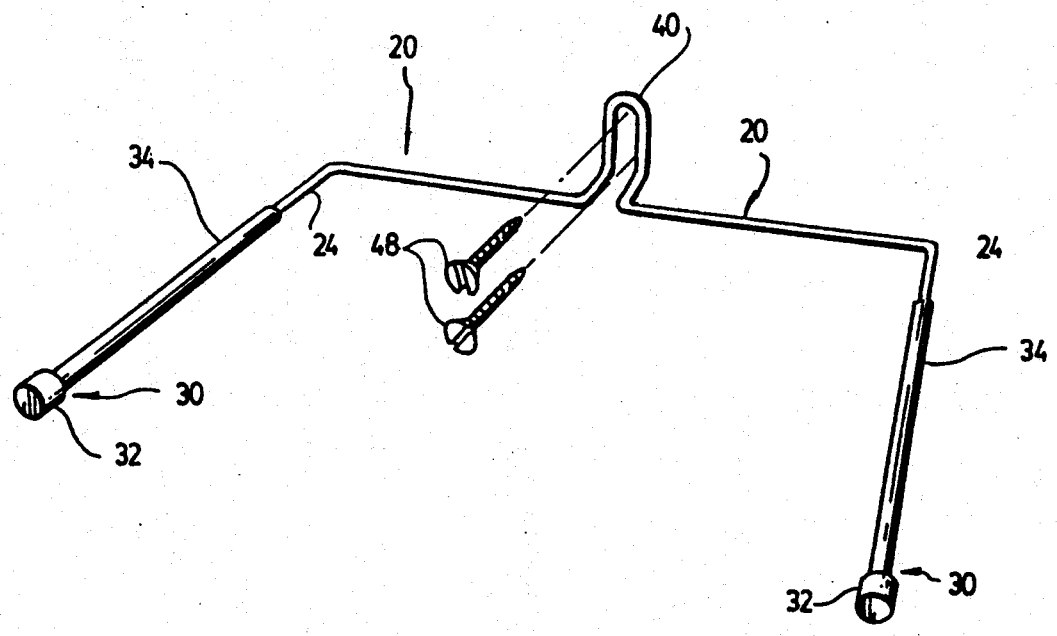
FIG. 14 is a perspective view of the bag holder with a middle stem allowing screws to be inserted therein.

FIG. 14 shows a rod 20 with a middle stem 40 designed so that the gap 41 between the left and right parts of the stem 40 is narrow enough to accommodate the insertion of screws 48 so the rod 20 can be fixed to an object, such as a wall or behind a door. The stem 40 extends horizontally and then vertically, integrally projecting therefrom.

Figure 15:
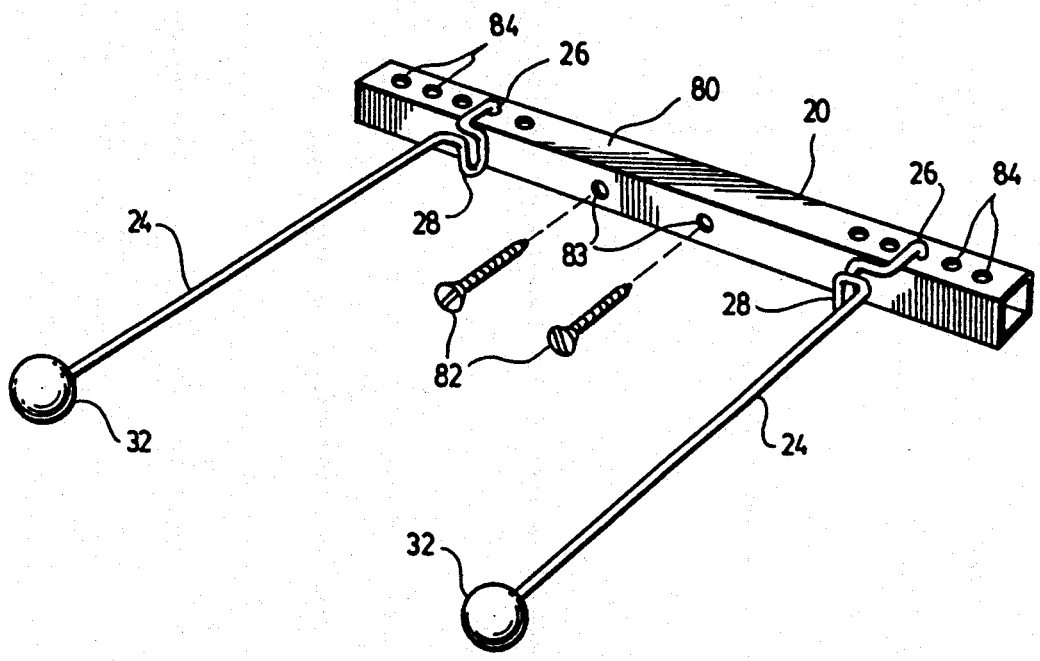
FIG. 15 is a perspective view of the bag holder according to another embodiment of the invention.

Another embodiment of the invention is shown in FIG. 15. The rod 20 has a rectangular cross-sectional shape and each of the arms 24 has an end 26 engaged in one of the holes 84 on the horizontal surface 80. The holes 84 have corresponding holes (not shown) made on the opposite horizontal surface and the ends 26 extend therethrough.

The arms 24 have a U-shaped side extension which substantially consists of two symmetrical parts.

As shown in FIG. 15, the arm 24 has a forward end on which is mounted a large, substantially rounded heads 32. Following the path of the arms 24, the arms 24 have a first straight segment that extends towards the rod 20. The arms 24 are then bent in the horizontal plane of about 90° towards the center of the rod 20 and a second straight segment that extends for a short distance. A second bend is made in the vertical plane towards the ground after which a third straight segment extends downwardly for a short distance. A third bend is made in a vertical plane perpendicular to the rod and forms a U-shaped bent, so that a fourth segment can extend straight, parallel to the third segment. A fourth bend in a vertical plane perpendicular to the rod 20 is followed by a fifth straight horizontal segment parallel to the second segment. A fifth bend, in the horizontal plane, is followed by a sixth straight, horizontal segment. Finally, a sixth bend, vertical and perpendicular to the rod 20, is followed by a seventh straight, vertical segment which is the end 26 inserted in the holes 84.

In use, the upper edge of the bag (not shown) is set around the arms 24 and the rear portion of the edge is set around the U-shaped bent 28, between the two symmetrical portions. The front portion of the edge is set around the heads 32, applying a pressure tightening the upper edge of the bag.

Of course, welded segments can be provided instead of bent segments.

According to the size of the bag, the arms 24 are mounted to one of the holes 84. Moreover, the user can bend the arms 24 to obtain a better fitting.

The rod 20 is held in place by means of two screws 82 inserted through the holes 83, and then emerging from behind to penetrate an object, such as a wall or a counter (not shown). Of course, other attaching means are possible.

To avoid a rotation of the arms 24 while the bag is in position, the two U-shaped bends 28 act as stoppers, keeping the arms substantially at right angle with reference to the rod 20. When the bag is not in place, the arms 24 can be either moved out of the holes 84 for storage at another location, or swung sidewardly to a position where the arms 24 are parallel to the rod 20. This is very convenient when cleaning around the bag holder.

When the bag is in place, the two heads 32 tend to move closer due to the tightening forces, therefore slightly bending the arms 24. The spring force generated by this bending further contributes to the tightening of the upper edge of the bag.

I claim:

1. A bag holder for holding open bags of various sizes, said bag holder comprising:

a rod having a main portion and two side arms integrally projecting from said main portion and extending forwardly, bent perpendicularly to said main portion, each of said two arms having an end and being bent substantially according to the size of the bag;

two end members, each mounted on the end of one of said arms, said end members having a large rounded head projecting forwardly therefrom;

male and female variable length interconnecting means provided between each of said end members and their corresponding arm, thereby allowing the end members to be moved to a desired position according to the size of said bag; and means to support said rod;

wherein said bag has an upper edge which is set around said rod, said arms and said end members in order to be held and kept open, said large head of said end member applying a pressure to tighten said upper edge of said bag without puncturing it.

2. The bag holder of claim 1, wherein said arms are bendable by the user.

3. The bag holder of claim 1 wherein said end members comprise sleeves slidable about said ends of said arms, said interconnecting means including a slight curving of the end of said arms generating holding friction forces inside said sleeves when they are mounted on the end of one of said arms.

4. The bag holder of claim 1, wherein said main portion of said rod has at least one middle stem projecting therefrom acting as a link between said rod and said means to support said rod.

5. The bag holder of claim 4, wherein said at least one middle stem is formed by a U-shaped bend in said rod.

6. The bag holder of claim 4, wherein said means to support said bag holder is a vertical post with a stem receiving upper end.

7. The bag holder of claim 6, wherein said vertical post has a sharp end.

8. The bag holder of claim 7, further comprising a foot pedal rigidly attached to said vertical post, such that a force applied on said foot pedal moves the sharp end into the ground.

9. The bag holder of claim 6, further comprising a ground support comprising two parallel horizontal arms extending forwardly to avoid toppling of said bag holder, and having an upper end engaging a lower end of the stem.

10. The bag holder of claim 4, wherein said means to support said bag holder is a handle.

11. The bag holder of claim 1, wherein said means to support said rod comprise vertical post having a C-shaped vise, made of a high friction material, inserted by force around said post at a desired height, said rod having a supporting means that is laid on said vise to hold said rod in use.

12. The bag holder of claim 11, wherein said supporting means is a middle stem projecting from said main portion of said rod, said stem being formed by a U-shaped bend in said rod.

13. The bag holder of claim 5, wherein said means to support said rod are screws inserted through said U-shaped bend.

14. A bag holder for holding open bags of various sizes, said bag holder comprising:

a rod having a main portion and two side arms integrally projecting from said main portion and extending forwardly, bent perpendicularly to said main portion, each of said two arms having an end and being bent substantially according to the size of the bag, said arms being bendable by the user;

two slidable sleeves, each mounted on the end of one of said arms, said sleeves having a large rounded end projecting forwardly therefrom and being slid to a desired position according to the size of said bag;

a slight bending of the end of said arms in order to generate a friction force applied inside said sleeves to hold them in position;

a vertical post supporting said rod, said post having a stem receiving upper end;

means to hold said post; and at least one middle stem, located on said middle portion, said stem acting as a link between said rod and said vertical post;

wherein said bag has an upper edge, set around said rod and said sleeves, to be held and kept open, said large head of said sleeves applying a pressure to tighten said upper edge around said rod without puncturing said bag.

* * * * *